US005970864A

United States Patent [19]

Svec

[11] Patent Number: 5,970,864

[45] Date of Patent: Oct. 26, 1999

[54] STENCILING DEVICE WITH REGISTRATION APPARATUS

[76] Inventor: Daniel C. Svec, 3816 SW. 2nd St., Des Moines, Iowa 50315

[21] Appl. No.: 09/073,628

[22] Filed: May 6, 1998

[51] Int. Cl.[6] ..... B41F 17/08

[52] U.S. Cl. ..... 101/38.1

[58] Field of Search ..... 101/35, 38.1, 39, 101/40, 40.1

[56] References Cited

U.S. PATENT DOCUMENTS

| | | | |
|---|---|---|---|
| 2,971,629 | 2/1961 | Black | 101/40 |
| 3,090,300 | 5/1963 | Dubuit | 101/123 |
| 3,260,194 | 7/1966 | Karlyn | 101/38 |
| 4,111,118 | 9/1978 | Green et al. | 101/123 |
| 4,502,380 | 3/1985 | Meador | 101/38.1 |
| 5,339,732 | 8/1994 | Peterlini et al. | 101/38.1 |
| 5,490,456 | 2/1996 | Richardson et al. | 101/35 |
| 5,711,217 | 1/1998 | Boring | 101/38.1 |
| 5,857,409 | 1/1999 | Derrickson | 101/38.1 |

*Primary Examiner*—Edgar Burr
*Assistant Examiner*—Amanda B. Sandusky
*Attorney, Agent, or Firm*—G. Brian Pingel

[57] ABSTRACT

A stenciling device for applying a multi-color design on a cylindrical object includes a registration assembly for synchronizing the rotational speed of the object to be stenciled with a silk screen assembly. The registration assembly includes a cable assembly that is interconnected between the silk screen assembly and a rotation member that is adjustable to increase or decrease the size of its circumference so that it conforms to the size of the object to be stenciled.

6 Claims, 5 Drawing Sheets

STENCILING DEVICE WITH REGISTRATION APPARATUS

BACKGROUND OF THE INVENTION

1. Field of the Invention

The present invention relates in general to automatic stenciling apparatus and more specifically to such apparatus for stenciling multi-color designs on cylindrical objects having a registration apparatus adapted for use with a laterally moving silk screen.

2. Description of the Prior Art

Automatic stenciling apparatus are known in the art for rotatably supporting a bottle, mug or other cylindrical object against the surface of a silk screen having a prepared design to cause the bottle to rotate in registration with the design. In the process of stenciling cylindrical or nearly cylindrical objects, the frictional driving engagement between the object and the silk screen causes rotation of the object and produces a satisfactory image. However, such means of maintaining registration between the object and the screen does not prove satisfactory for multi-colored stencils for which a precise registration between the screen and the object is required.

To provide more precise registration between the object and the screen, it is known in the art to provide a positive driving connection between the screen frame and the mount supporting the object such that the translation of the screen rotates the object in synchronism, thereby preventing relative slippage between the surface being stenciled and the screen. Examples of prior art mechanisms having such a positive driving connection are shown in U.S. Pat. Nos. 3,090,300; 3,260,194 and 4,111,118. One of the more currently used type of systems is detailed in U.S. Pat. No. 3,260,194 and includes a pinion gear attached to one end of a rotatable shaft and a device for holding the object to be printed attached to the other end. Meshed with the pinion gear is a rack, mounted horizontally with a linear bearing at each end. Vertical rods attached to the back of a screen assembly engage these linear bearings allowing the rack to move laterally in synchronization with the screen, while remaining meshed with the pinion when the item holder is lowered from the screen for loading and unloading. As the screen and rack move laterally, the rack transfers the horizontal linear motion of the screen to rotational motion of the object being printed, allowing the image in the flat horizontally mounted screen to be transferred to the curved surface of the item.

Critical factors involved in registering multi-color printing include closely matching the rotation rate of the item with the linear rate of the screen, a 1:1 ratio between their surfaces being ideal and critical, and a smooth, accurate rotational motion with no slop or back-lash to introduce left and right variation into the relative location of the imprint colors.

The current rack and pinion systems require an extensive inventory of expensive and in many cases custom made pinion gears to accommodate items of differing diameters. The minimum increment of adjustment is one gear tooth, typically 1/10th of an inch. Multicolor printing requires registration tolerances as low as 1/100th of an inch, so the rack and pinion gear system is generally not accurate enough to product high-quality multi-color imprints, especially on coffee mugs and plastic bottles.

In new rack-and-pinion gear systems, a certain amount of clearance or space must be provided between the mating gear teeth to facilitate smooth operation, or binding and rumble or rough operation will result. As rack and pinion gears wear, the clearance or back-lash increases, and there is no method of adjusting or compensating for this wear (other than to replace both the pinion and rack gears), so these systems tend to develop inaccuracies as they are used. These factors along with the high cost of maintaining an inventory of many different sized gears, are addressed by the present invention.

Although the invention disclosed in U.S. Pat. No. 3,260,194 provides an assembly that improves the registration between the movement of the screen and the article, it is not adapted to provide the precise registration necessary for the stenciling of multi-color designs on articles or to avoid the back-lash that is inherent in a rack and pinion system.

SUMMARY OF THE INVENTION

The present invention provides a device for stenciling a design on the exterior surface of an object. The device includes a holding means for supporting an object to be stenciled, screen means overlying the object and movable in a transverse direction thereto, and registration means for synchronizing the rotation of the object with the movement of the screen means so that the surface speed of the object is matched with the speed of the screen means In a preferred embodiment, the holding means include a rotation means in the form of a pulley that has an adjustable circumference that can be sized to conform to the circumference of the object. The pulley is employed with a cable assembly to provide an interconnection between the holding means and the screen means to synchronize the speeds thereof.

DETAILED DESCRIPTION OF THE PREFERRED EMBODIMENT

Figure 1:
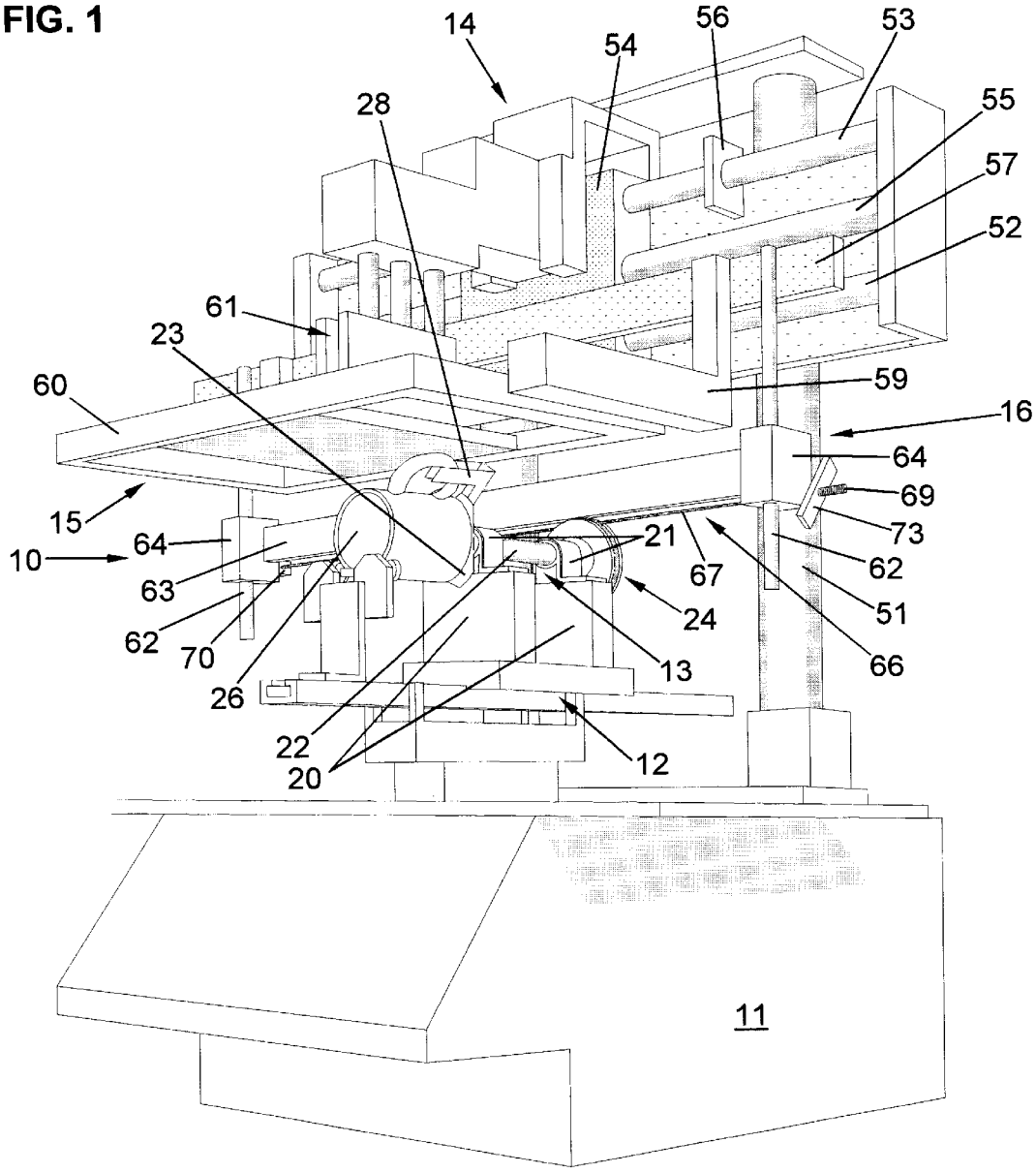
FIG. 1 is a side perspective view of a preferred embodiment of the stenciling device of the present invention.
Figure 2:
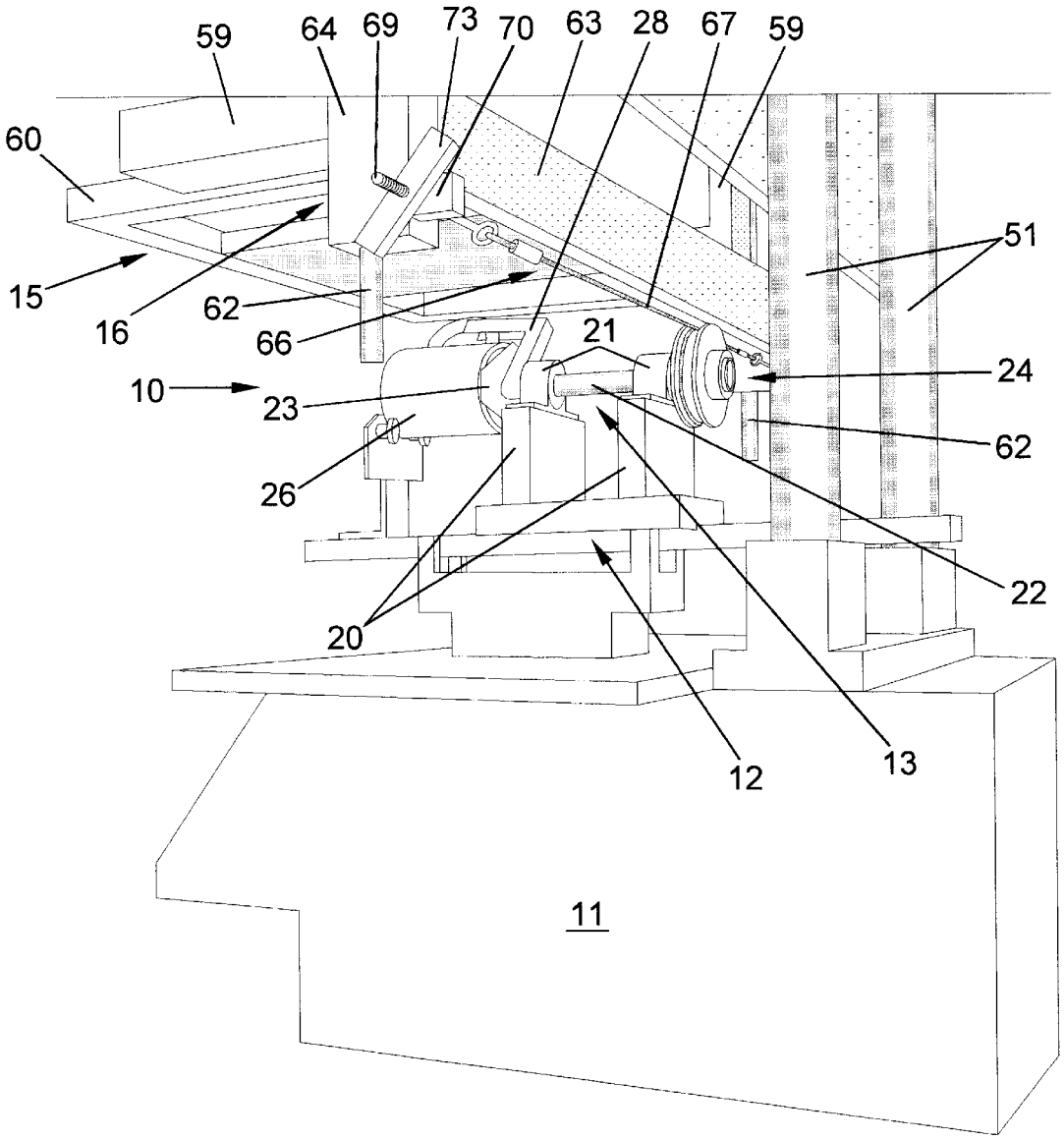
FIG. 2 is a perspective view of the opposite side of the embodiment of FIG. 1.

Referring now to the drawings and with reference first to FIGS. 1 and 2, a preferred embodiment of the stenciling device of the present invention is shown at 10 and principally is formed of a base 11, a platform 12 on which a holding means 13 is rotatably mounted, a carriage means 14 for supporting a screen means 15 above the holding means 13 and a registration means 16 for synchronizing the movement of the screen means 15 with the rotation of the holding means 13.

The base 11 is preferably formed from a rigid metal to serve as a foundation for the remainder of the device 10. The platform 12 preferably is connected to the base 11 in a supporting arrangement for vertical movement to raise or lower the holding means by suitable control means as is known in the art and that forms no part of the present invention. The platform 12 includes a pair of spaced apart upwardly extending rectangularly shaped blocks 20 that each have a bearing 21 mounted on their upper end to form a trunnion type support for the holding means 13.

The holding means 13 is formed of an axle 22 rotatably received in the bearings 21, a mandrel-type member 23 mounted on one end of the axle 22 for holding an object to be stenciled, such as a cup 26, during the stenciling operation in a fixed position with respect thereto, and a rotation means 24 secured to the opposite end of the axle 22. The rotation means 24 preferably is in the form of a pulley 25 that has an adjustable circumference that may be varied in size to conform to the size of the cup 26 being stenciled. Preferably the mandrel 23 includes a chuck (not shown) to engage the bottom of the article, guide wheels (not shown) to support the opposite end and a restraining finger means 28 for engaging the handle of the cup 26.

Figure 3:
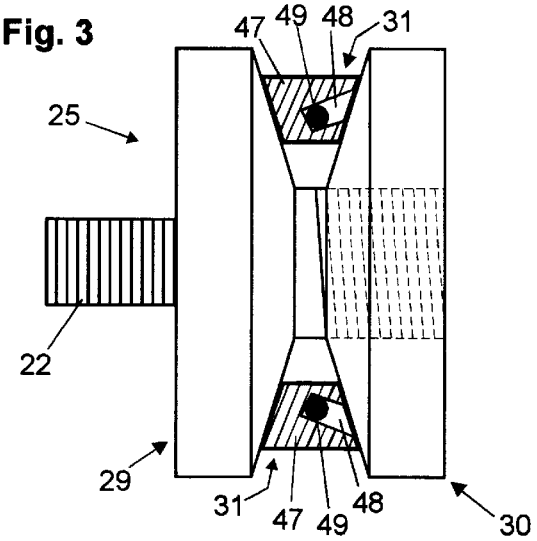
FIG. 3 is a side view of a pulley that is employed in the preferred embodiment and is formed of two side members and a segmented ring that is shown in cross-section for purposes of illustrating the configuration of such ring.
Figure 8:
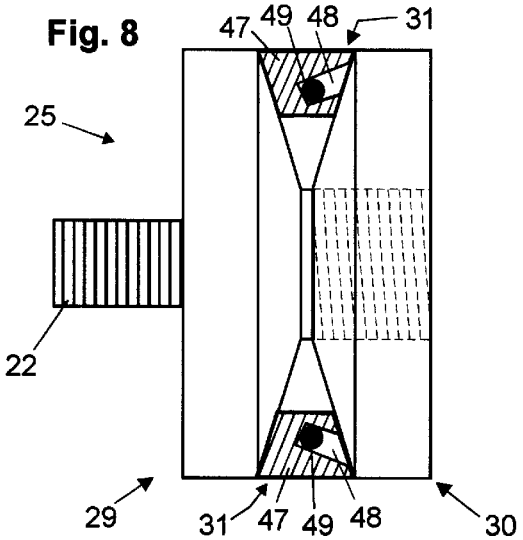
FIG. 8 is a view of the pulley of FIG. 3 but with the side members screwed closer together to increase the circumference of the segmented ring.
Figure 4:
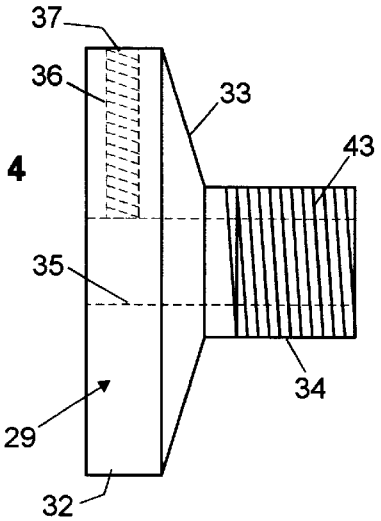
FIG. 4 is a side view of one of the side members of the pulley of FIG. 3.
Figure 5:
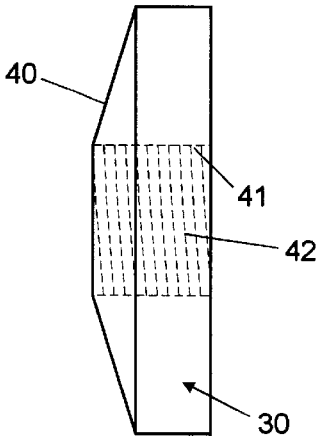
FIG. 5 is a side view of the other side member of the pulley of FIG. 3.

Referring now to FIG. 3, the pulley 25 is preferably constructed of side members 29 and 30 and a segmented ring 31 positioned between the side members 29 and 30, with such components being formed from metal or rigid plastic. As shown in FIG. 4, the side member 29 has a disk shaped head portion 32 and a beveled interior surface 33 from which a hub portion 34 extends. The member 29 further includes a central bore 35 for receiving one end of the axle 22. A key way 36 is formed in the member 29 and is threaded to mate with a set screw 37 to secure the member 29 to the axle 22. The side member 30, as seen in FIG. 5, is also disk shaped and has a beveled interior surface 40. A central bore 41 is formed in the member 30 and has threads 42 that correspond to threads 43 on the hub 34. Thus, the members 29 and 30 can be threadingly mated together with their respective interior surfaces 33 and 40 spaced apart according to how far the member 30 has been screwed onto the hub of the member 29, as represented by FIG. 8.

Figure 6:
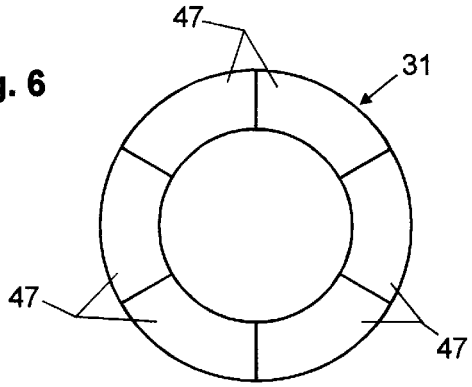
FIG. 6 is a side view of the segmented ring of FIG. 3.
Figure 7:
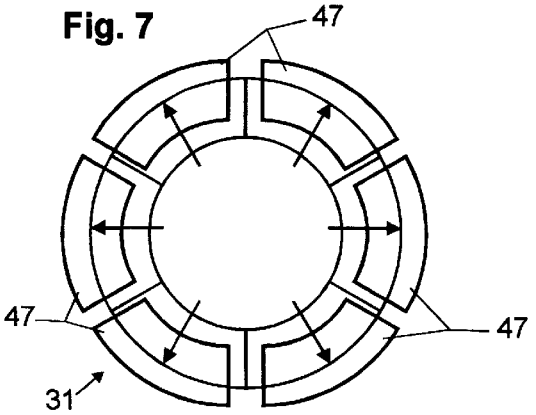
FIG. 7 is a schematic view of the ring of FIG. 3 showing how its circumference is expandable.

With reference to both FIGS. 3 and 6, the segmented center ring 31 is formed of arcuate shaped segments 47 that have a wedge shaped cross section as best shown in FIG. 3. Each segment 47 is slotted on one side at 48 for receiving an O-ring 49 that acts as a retention means to maintain the segments 47 in a circular arrangement when sandwiched between the side members 29 and 30.

Due to the beveled interior surfaces 33 and 40 of the side members 29 and 30 respectively and the shape of the segments 47, the circumference of the ring 31 can be varied in size by adjusting the spacing between the members 29 and 30. As the member 30 is drawn closer to the member 29, the segments 47 move in a radial direction to spread apart and provide an increased diameter for the rotation means 24, all for a purpose to be described below.

Referring again to FIGS. 1 and 2, the carriage means 14 is supported above the holding means 13 by a pair of posts 51. Included as part of the carriage means 14 are a pair of horizontally aligned guide bars 52 and 53 and a carriage 54 that is slidably mounted on the rods 52 and 53 for horizontal movement to the left or right. A dual action air cylinder 55 is connected to the carriage 54 to move it back and forth at a controlled rate of speed when desired. A pair of stop clamps 56 (only one of which is shown in FIG. 1) are secured on the rod 53 to regulate the amount of travel of the carriage 54 as desired.

A side bar 57 is attached to one side of the carriage 54 and serves as a support for a pair of brackets 59 that form together with a silk screen assembly 60 the screen means 15 with the screen assembly 60 overlying the cup 26. A squeegee assembly 61 engages the upper surface of the screen assembly 60 and acts to push ink through the open areas of such assembly during the stenciling cycle transferring the design to the cup 26 as the screen assembly 60 is moved transverse to the cup 26, as is known in the prior art.

To provide a positive driving connection between the movement of the screen assembly 60 and the rotation of the cup 26, the registration means 16 is employed. As shown best in FIG. 1, the registration means 16 includes a pair of vertically aligned support rods 62 that are attached to the side bar 57 and are movable therewith, a rigid spacer bar 63 that is attached at its ends to linear bearing blocks 64, and a cable assembly 66 formed from a cable 67 with threaded ends 68 and 69 (both shown only in FIG. 9) respectively attached between the bearing blocks 64. The mounting for the cable assembly 66 is shown in FIGS. 2 and 9 and consists of an ear 70 on each of the bearing blocks 64.

Figure 9:
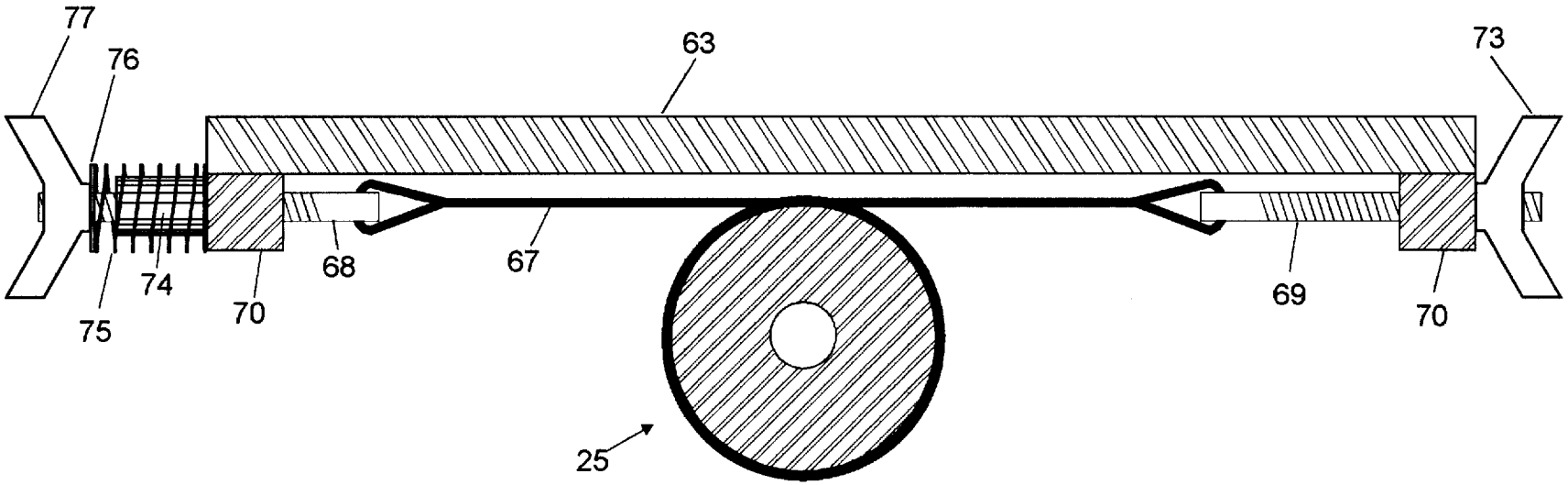
FIG. 9 is a schematic view of a registration means that is employed with the pulley of FIG. 3.

To best illustrate the specific arrangement of the cable assembly 66 with the spacer bar 63, a schematic view of these components together with the pulley 25 is shown in FIG. 9. As can be seen, the threaded ends 68 and 69 of the cable 67 are extended through the ears 70. The end 69 is secured in position by a wing nut 73. To provide a tensioning means for the cable assembly 66, the threaded end 68 is extended through a metal sleeve 74 and a coil spring 75, a washer 76 and a wing nut 77. The coil spring 75, serves to maintain a low level of tension on the cable 67 during adjustment of the circumference of the pulley 25. By tightening the wing nut 77 on the end 68, the tension on the cable assembly 66 can be increased up to the point that the spring 75 is compressed to the metal sleeve 74, at which point the action of the spring 75 is eliminated and high tension can be applied to the cable assembly 66, eliminating all slippage during operation. Due to the wedge-shaped nature of the segmented ring 31, high tension on cable assembly 66 also serves to provide a locking action on the pulley eliminating possible inadvertent adjustment during operation.

Because the cable 67 is wound around the pulley 25, horizontal movement of the spacer bar 63 will cause rotation of the pulley 25. Likewise, due to the interconnection between the bar 63 and the screen assembly 60 that is provided via the rods 62 and carriage means 14, the screen assembly 60 and bar 63 move in direct correspondence to one another. This means that so long as the diameter of the pulley 25 is equal to the diameter of the cup 26, the surface speed of the cup 26 and the screen assembly 60 will be matched as previously explained above. Due to the construction of the segmented ring 31 and shape of the side members 29 and 30, the circumference of the pulley 25 provided by the ring segment 31 can be precisely adjusted in size in a quick and easy fashion. By adjusting the tension on the cable assembly 66, all backlash is eliminated and any wear is compensated for, extending the accurate life of the device 10.

Figure 10:
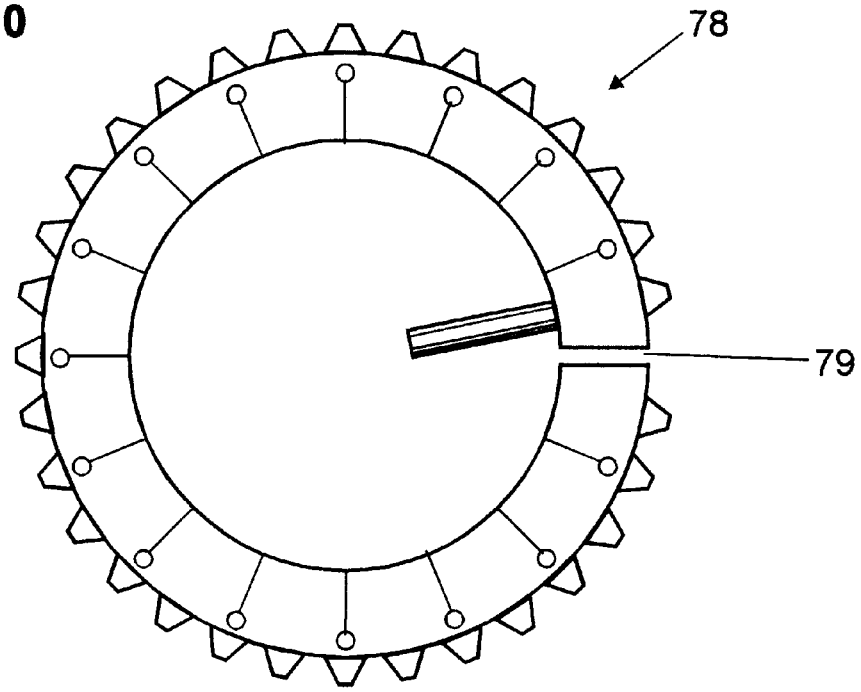
FIG. 10 is a pinion gear that provides an alternative to use of the pulley of FIG. 3.

It should be noted that one of the key features of the present invention is the use of a rotation means that can be quickly and easily adjusted in size in contrast to the fixed size rack and pinion systems used in the prior art. However, it should be recognized that other types of systems may be designed using the principle of the present invention. For example, referring to FIG. 10, a simplified view of a modified pinion gear 78 employing the principle of the present invention is shown. The pinion gear 78 is designed so that it can be substituted for the segmented ring 31 between the side members 29 and 30. The body of the gear 78 has a gap at 79 that will allow the circumference of the gear 78 to enlarge as the side members 29 and 30 are screwed together in somewhat similar fashion to the segmented ring 31. The gear 78 can then be used with the typical rack construction as known in the prior art rather than using the cable assembly 66.

Figure 11:
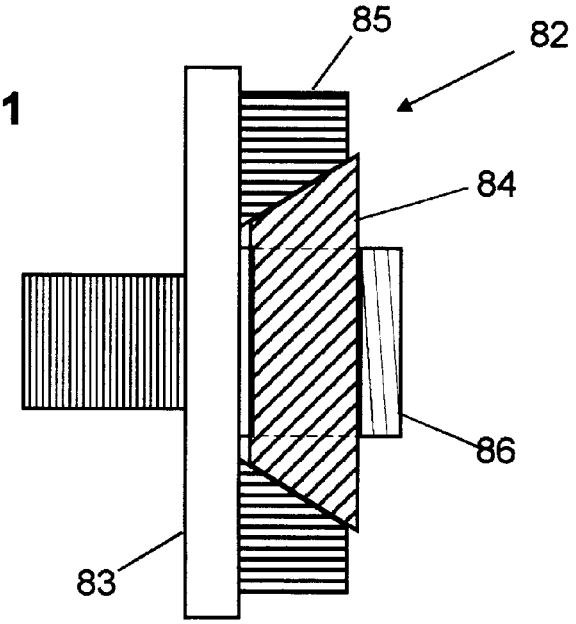
FIG. 11 is an alternative construction that can be used instead of that shown in FIG. 3 for the pulley.

As another alternative for the construction of the pulley 25, a modified pulley 82 is shown in FIG. 11. The pulley 82 includes a disk shaped side member 83, a wedge shaped side member 84 and a segmented ring 85 that is sloped to conform to the shape of the member 84. The side member 83 has a hub 86 so that the side member 84 can be screwed thereon to provide a wedging action to expand the ring 85 as was accomplished with the pulley 25.

In addition to the above, those skilled in the art should also be aware that other changes and variations may be made that differ from the showing of the preferred embodiment herein and would still fall within the true spirit and scope of the present invention.

What is claimed is:

1. A device for stenciling a design on the exterior surface of an object, said device comprising:

(a) a base;

(b) platform means associated with said base;

(c) holding means rotatably mounted on said platform means and having:

(1) a mandrel for holding said object during stenciling; and (2) rotation means associated with said mandrel to cause rotation thereof;

(d) carriage means positioned above said holding means for movement in a transverse direction to said object;

(e) means for supporting said carriage means;

(f) screen means overlying said object and associated with said carriage means for movement therewith;

(g) means for vertically moving one of said platform means and said carriage means between a position in which said screen means engages said object and a position in which said screen means is spaced from said object;

(h) registration means associated with said rotation means and said carriage means to synchronize the rotation of said object with the movement of said screen means so that the surface speed of said object is matched with the speed of the screen means; and (i) said rotation means is adjustable to vary the circumference thereof so that such means can be sized to conform to the circumference of said object.

2. A stenciling device as recited in claim 1, wherein said rotation means is comprised of:

(a) a first side member;

(b) a second side member that is spaced from said first side member and is threadably engaged therewith; and (c) a ring member sandwiched between said side members and having a configuration that conforms to the configuration of at least one of said side members so that when the spacing between the side members is reduced, the circumference of the center ring will be increased.

3. A stenciling device as recited in claim 2, wherein said rotation means is a pulley and said ring member is formed of a plurality of wedge shaped segments.

4. A stenciling device as recited in claim 3, wherein said segments of said pulley ring member are maintained in a circular configuration by an O-ring.

5. A stenciling device as recited in claim 3, wherein said registration means is formed of a cable assembly in association with said pulley, which cable assembly is interconnected with said screen means.

6. A stenciling device as recited in claim 5, wherein said cable assembly comprises:

(a) means for connecting the threaded ends of said cable to said spacer bar in such fashion that tension is applied on said cable.

* * * * *